United States Patent [19]

Tachibana et al.

[11] Patent Number: 4,916,784

[45] Date of Patent: Apr. 17, 1990

[54] WARP-DRAWING APPARATUS

[75] Inventors: Juro Tachibana, Matsuyama; Yoshihide Nishimura, Iyo, both of Japan

[73] Assignee: Teijin Seiki Company Limited, Osaka, Japan

[21] Appl. No.: 204,123

[22] Filed: Jun. 8, 1988

[30] Foreign Application Priority Data

| | | | |
|---|---|---|---|
| Jun. 18, 1987 | [JP] | Japan | 62-153002 |
| Jun. 18, 1987 | [JP] | Japan | 62-153003 |
| Jun. 18, 1987 | [JP] | Japan | 62-153004 |
| Jun. 18, 1987 | [JP] | Japan | 62-153006 |

[51] Int. Cl.[4] ..... D03J 1/14

[52] U.S. Cl. ..... 28/203

[58] Field of Search ..... 28/203, 204, 205, 206, 28/207

[56] References Cited

U.S. PATENT DOCUMENTS 4,723,346 2/1988 Tachibana et al. .

FOREIGN PATENT DOCUMENTS 63-295744 12/1988 Japan .
348937 10/1960 Switzerland .
593660 10/1947 United Kingdom .

*Primary Examiner*—Henry S. Jaudon
*Assistant Examiner*—Bradley K. DeSandro
*Attorney, Agent, or Firm*—Cushman, Darby & Cushman

[57] ABSTRACT

A warp-drawing apparatus for drawing a warp thread through an eye of a heddle, comprising a compression nozzle which is provided in one side of the heddle and formed with a compression passageway through which the warp thread is drawn and formed with a nozzle passageway through which compression air is injected, a suction nozzle which is provided in the other side of the heddle and formed with a suction passageway through which the warp thread is drawn and formed with a nozzle passageway through which compression air is injected, and suction means for drawing air from an exit of the suction passageway of the suction nozzle in a direction in which the warp thread is drawn through the eye of the heddle.

12 Claims, 12 Drawing Sheets

WARP-DRAWING APPARATUS

FIELD OF THE INVENTION

The present invention relates to a warp-drawing apparatus for drawing a warp thread through an eye of a heddle for a loom.

DESCRIPTION OF THE PRIOR ART

Conventionally, a warp-drawing apparatus has been employed wherein a warp thread is drawn through an eye of a heddle by means of a hook member with a hook end. The hook member is first passed through the heddle eye, and then the warp thread is held on the hook end of the hook member and drawn through the heddle eye by withdrawing the hook member. Such a warp-drawing apparatus however has several disadvantages. The first drawback is that the hook member may fail to pass through the heddle eye by the fact that the heddle eye is standardized and that the hook member to be inserted into the heddle eye cannot be reduced in cross sectional dimensions since the hook end of the hook member is limited in mechanical strength. The second drawback is that the hook member cannot be rapidly passed through the heddle eye due to the limitation in mechanical strength, resulting in decrease in the speed of drawing the warp thread through the heddle eye. The third drawback is that the warp thread is subject to being cut because it is drawn through the heddle eye by the thin hook member.

Accordingly, an object of the present invention is to provide an improved warp-drawing apparatus in which the warp thread is surely drawn through the heddle eye with high operational efficiency by the use of air flow of high speed without having recourse to the use of the hook member.

SUMMARY OF THE INVENTION

In accordance with an important aspect of the present invention, there is provided a warp-drawing apparatus for drawing a warp thread through an eye of a heddle, comprising a compression nozzle which is provided in one side of the heddle and formed with a compression passageway through which the warp thread is drawn and formed with a nozzle passageway through which compression air is injected, a suction nozzle which is provided in the other side of the heddle and formed with a suction passageway through which the warp thread is drawn and formed with a nozzle passageway through which compression air is injected, and suction means for drawing air from an exit of the suction passageway of the suction nozzle in a direction in which the warp thread is drawn through the eye of the heddle.

The compression nozzle and suction nozzle may be arranged in an axial alignment with each other and movable toward and away from each other. The suction means may be movable together with the suction nozzle. The compression passageway of the compression nozzle may have a cross section which is gradually reduced in the direction in which the warp thread is drawn through the eye of the heddle, and the suction passageway of the suction nozzle may have a cross section which is gradually reduced in the direction in which the warp thread is drawn through the eye of the heddle.

The compression nozzle may comprise a first nozzle block and a second nozzle block movable toward and away from the first nozzle block, the first and second nozzle blocks defining the compression passageway through which the warp thread is drawn. The compression passageway may have a generally square cross section which is gradually reduced in the direction in which the warp thread is drawn through the eye of the heddle, a taper surface forming the lower side of the square being formed in the first nozzle block and taper surfaces forming the other sides of the square being formed in the second nozzle block.

The suction nozzle may comprise a first nozzle block and a second nozzle block movable toward and away from the first nozzle block, the first and second nozzle blocks defining the suction passageway through which the warp thread is drawn. The suction passageway may have a generally square cross section which is gradually reduced in the direction in which the warp thread is drawn through the eye of the heddle, a taper surface forming the lower side of the square being formed in the first nozzle block and taper surfaces forming the other sides of the square being formed in the second nozzle block.

The suction nozzle may comprise a plurality of suction nozzle units each formed with a suction passageway through which the warp thread is drawn and each formed with a nozzle passageway through which compression air is injected. Each of the suction nozzle units may be movable toward and away from the heddle. Each of the suction nozzle units may comprise a first nozzle block and a second nozzle block movable toward and away from the first nozzle block, the first and second nozzle blocks defining the suction passageway through which the warp thread is drawn. The suction passageway of each of the suction nozzle units may have a generally square cross section which is gradually reduced in the direction in which the warp thread is drawn through the eye of the heddle, a taper surface forming the lower side of the square being formed in the first nozzle block and taper surfaces forming the other sides of the square being formed in the second nozzle block.

The compression nozzle may comprise a plurality of compression nozzle units each formed with a compression passageway through which the warp thread is drawn and each formed with a nozzle passageway through which compression air is injected. Each of the compression nozzle units may be movable toward and away from the heddle. Each of the compression nozzle units may comprise a first nozzle block and a second nozzle block movable toward and away from the first nozzle block, the first and second nozzle blocks defining the suction passageway through which the warp thread is drawn. The compression passageway of each of the compression nozzle units may have a generally square cross section which is gradually reduced in the direction in which the warp thread is drawn through the eye of the heddle, a taper surface forming the lower side of the square being formed in the first nozzle block and taper surfaces forming the other sides of the square being formed in the second nozzle block.

BRIEF DESCRIPTION OF THE DRAWINGS

The features and advantages of a warp-drawing apparatus according to the present invention will be more clearly understood from the following description taken in conjunction with the accompanying drawings in which.

DETAILED DESCRIPTION OF THE PREFERRED EMBODIMENTS

Figure 1:
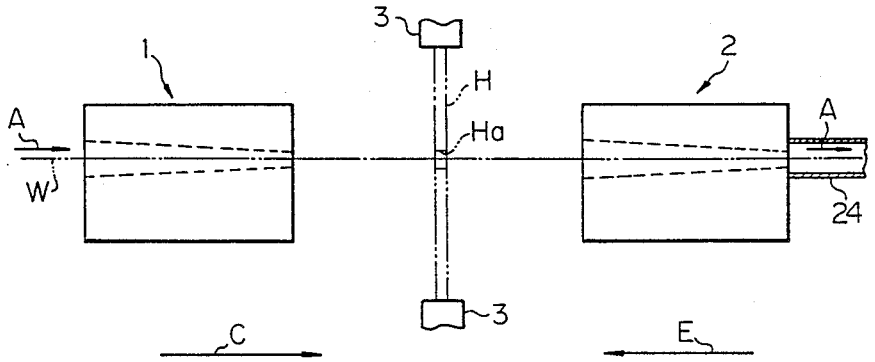
FIG. 1 is a schematic side view showing compression and suction nozzles of a warp-drawing apparatus in accordance with one embodiment of the present invention.

Referring now in detail to the drawings and initially to FIG. 1, there is shown a preferred embodiment of a warp-drawing apparatus for drawing a warp thread through an eye of a heddle for a loom. The warp-drawing apparatus comprises a compression nozzle generally designated by reference numeral 1 and a suction nozzle generally designated by reference numeral 2, which are arranged in an axial alignment with each other. The compression nozzle 1 is provided on one side of a heddle H with an eye Ha, while the suction nozzle 2 is provided on the other side of the heddle H so as to be movable in a direction indicated by the arrow E in FIG. 1 toward the compression nozzle 1 and in the opposite direction away from the compression nozzle 1. In drawing a warp thread W through the eye Ha of the heddle H, the suction nozzle 2 is advanced in the direction E toward the heddle H, and after the warp thread W is drawn through the eye Ha of the heddle H, the suction nozzle unit 2 is moved in the opposite direction away from the heddle H. A heddle-positioning means 3 is provided to hold the upper and lower ends of the heddle H and to position the heddle H between the compression and suction nozzles 1 and 2. In drawing the warp thread W through the eye Ha of the heddle H, the compression nozzle 1 is advanced in a direction indicated by the arrow C in FIG. 1 toward the heddle H, and after the warp thread W is drawn through the eye Ha of the heddle H, the compression nozzle 1 is moved back in the opposite direction away from the heddle H. The suction nozzle 2 and the compression nozzle 1 are driven to move toward and away from each other by suitable drive means.

Figure 2:
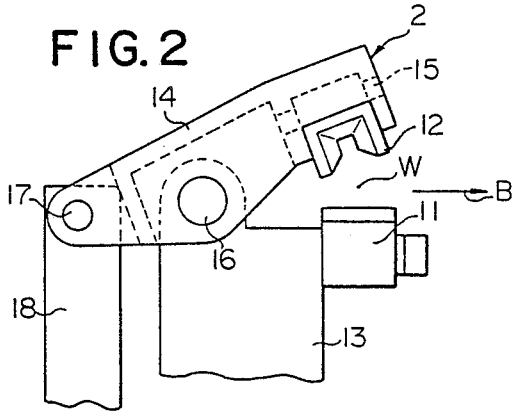
FIG. 2 is an enlarged front view, partly broken away, showing the suction nozzle shown in FIG. 1, wherein the second suction nozzle block thereof is moved away from the first suction nozzle block thereof to remove the warp thread that is drawn through an eye of a heddle.
Figure 3:
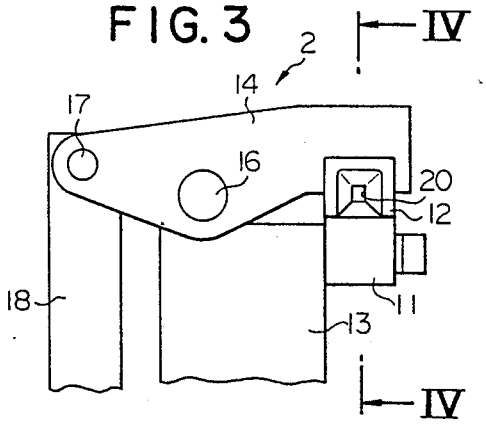
FIG. 3 is a view similar to FIG. 2 showing the suction nozzle wherein the second suction nozzle block thereof is in engagement with the first suction nozzle block thereof to form a suction passageway through which the warp thread is drawn.
Figure 4:
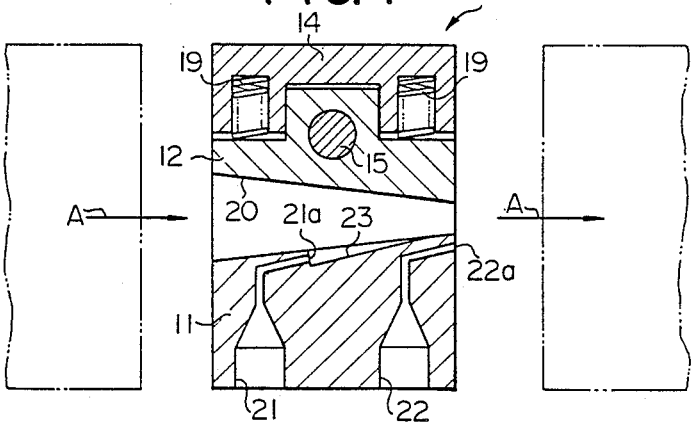
FIG. 4 is an enlarged cross sectional view, substantially taken along line IV—IV in FIG. 3, showing the suction passageway of the suction nozzle.

Referring to FIG. 2 through FIG. 4, the suction nozzle 2 comprises a first stationary nozzle block 11 and a second nozzle block 12 movable toward and away from the first stationary nozzle block 11. The first nozzle block 11 is stationarily mounted on a nozzle supporting member 13, while the second nozzle block 12 is rotatably mounted on a pivot arm 14 through a pin 15 fixed to the latter. The pivot arm 14 is pivotably mounted through a support pin 16 on the nozzle supporting member 13 and also connected through a connection pin 17 to a rod 18. The pivot arm 14 is caused to pivot on the support pin 16 by the upward and downward movements of the rod 18, and accordingly the second nozzle block 12 is movable toward and away from the first nozzle block 11. As clearly shown in FIG. 4, the second nozzle block 12 is urged toward the first nozzle block 11 by means of a pair of springs 19 and 19 each mounted in the pivot arm 14, and when the second nozzle block 12 is brought into engagement with the first nozzle block 11, the springs 19 and 19 serve to absorb the shocks of the both nozzle blocks 11 and 12.

When the second nozzle block 12 is held in engagement with the first nozzle block 11, they define therebetween a suction passageway 20 having a section which is gradually reduced in a direction A of air flow, as shown in FIG. 4. The suction passageway 20 has a generally square cross section, a taper surface forming the lower side of the square being formed in the first nozzle block 11 and taper surfaces forming the other sides of the square being formed in the second nozzle block 12. As a result, when the second nozzle block 12 is moved away from the first nozzle block 11, the warp thread W can be easily removed from the suction nozzle 2 in a direction indicated by the arrow B in FIG. 2. It is noted that, in order to easily remove the warp thread W from the suction nozzle 2, it is necessary to make the taper surface of the first nozzle block 11 as smooth as possible. As shown in FIG. 4, the first nozzle block 11 of the suction nozzle 2 is formed with a first nozzle passageway 21 having an open end 21*a* which is open to a recess 23 formed in the taper surface of the block 11, and is further formed with a second nozzle passageway 22 having an open end 22*a* which is open to the end face of the nozzle block 11 adjacent the exit end of the suction passageway 20. Compression air is injected from the first nozzle passageway 21 into the suction passageway 20 to cause the latter to become in a vacuum condition. Also, compression air is injected from the second nozzle passageway 22 to accelerate the air injected from the suction passageway 20.

A vacuum suction pipe or means 24 is provided rearward of the suction nozzle 2, i.e., downstream of the air flow. The vacuum suction pipe 24 is attached to the suction nozzle 2 and movable together with the latter, and serves to increase the suction force of the suction nozzle 2 by drawing the air from the exit end of the suction nozzle 2 in the direction A. When the compression nozzle 1 injects the compression air to the side of the suction nozzle 2, the compression nozzle 1 is held in engagement with the heddle H.

Figure 5:
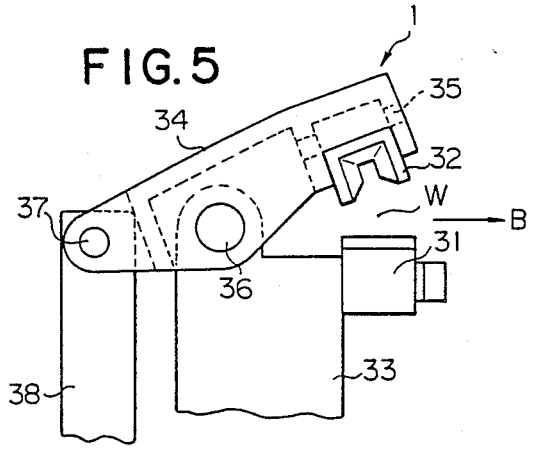
FIG. 5 is an enlarged front view, partly broken away, showing the compression nozzle shown in FIG. 1, wherein the second compression nozzle block thereof is moved away from the first compression nozzle block thereof to remove the warp thread that is drawn through the heddle eye.
Figure 6:
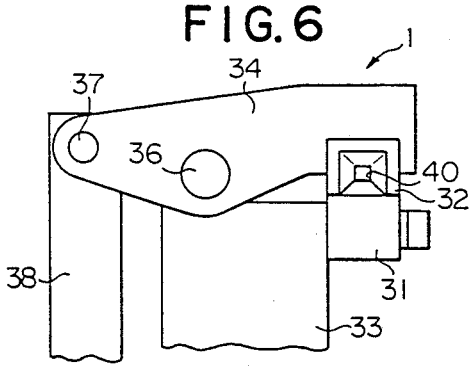
FIG. 6 is a view similar to FIG. 5 showing the compression nozzle wherein the second compression nozzle block thereof is in engagement with the first compression nozzle block thereof to form a compression passageway through which the warp thread is drawn.
Figure 7:
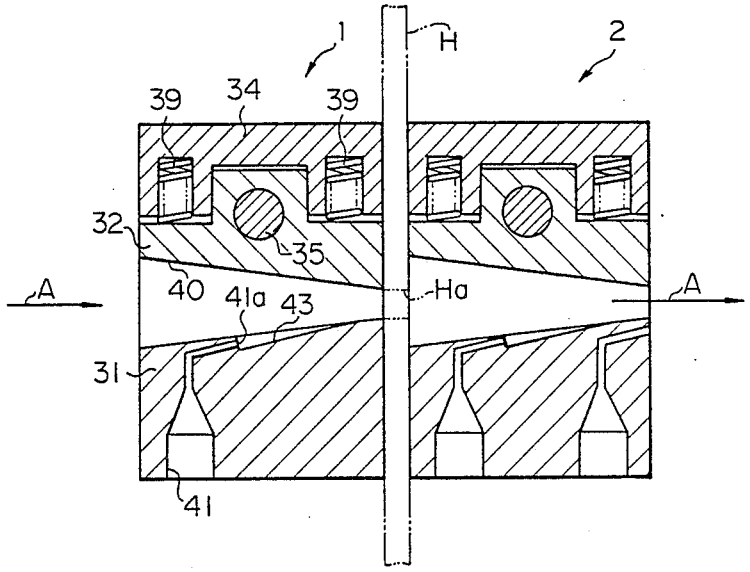
FIG. 7 is a longitudinal sectional view showing the compression and suction nozzles of FIG. 1 that have been advanced and engaged with the heddle.

Referring to FIGS. 5, 6 and 7, the compression nozzle 1 comprises a first stationary nozzle block 31 and a second nozzle block 32 movable toward and away from the first stationary nozzle block 31. The first nozzle block 31 is stationarily mounted on a nozzle supporting member 33, while the second nozzle block 32 is rotatably mounted on a pivot arm 34 through a pin 35 fixed to the latter. The pivot arm 34 is pivotably mounted through a support pin 36 on the nozzle supporting member 33 and also connected through a connection pin 37 to a rod 38. The pivot arm 34 is caused to pivot on the support pin 36 by the upward and downward movements of the rod 38, and accordingly the second nozzle block 32 is movable toward and away from the first nozzle block 31. As clearly shown in FIG. 7, the second nozzle block 32 is urged toward the first nozzle block 31 by means of springs 39 and 39 mounted in the pivot arm 34, and when the second nozzle block 32 is brought into engagement with the first nozzle block 31, the springs 39 and 39 serve to absorb the shocks of the both nozzle blocks 31 and 32.

When the second nozzle block 32 is held in engagement with the first nozzle block 31, they define therebetween a compression passageway 40 having a section which is gradually reduced in the direction wherein the warp thread W is drawn, i.e., in the direction A of air flow, as shown in FIG. 7. The compression passageway 40 has a generally square cross section, a taper surface forming the lower side of the square being formed in the first nozzle block 31 and taper surfaces forming the other sides of the square being formed in the second nozzle block 32. As a result, when the second nozzle block 32 is moved away from the first nozzle block 31, the warp thread W can be easily removed from the compression nozzle 1 in a direction indicated by the arrow B in FIG. 5. It is noted that, in order to easily remove the warp thread W from the compression nozzle 1, it is necessary to make the taper surface of the first nozzle block 31 as smooth as possible. As shown in FIG. 7, the first nozzle block 31 of the compression nozzle 1 is formed with a nozzle passageway 41 having an open end 41*a* which is open to a recess 43 formed in the taper surface of the block 31. Compression air is injected from the first nozzle passageway 41 into the compression passageway 40 to cause the latter to become in a vacuum condition, and is supplied to the side of the suction nozzle 2 from the exit end of the compression passageway 40 through the eye Ha of the heddle H.

The operation of the warp-drawing apparatus above described will hereinafter be described in detail.

The heddle H is first positioned properly by the heddle-positioning means 3. Thereafter, the compression nozzle 1 is advanced in the direction C toward the heddle H, and the suction nozzle 1 is advanced in the direction E toward heddle H to hold the heddle H between the compression nozzle 1 and the suction nozzle 2. The first and second nozzle blocks 11 and 12 of the suction nozzle 2 are brought into engagement with each other, and also the first and second nozzle blocks 31 and 32 of the compression nozzle 1 are brought into engagement with each other. With these conditions, compression air is injected at high speed in the direction A of FIG. 1 from the nozzle passageways 21, 22 of the suction nozzle 2 and from nozzle passageway 41 of the compression nozzle 1, and furthermore the compression air is drawn by the vacuum suction pipe 24 attached to the suction nozzle 2.

Accordingly, the warp thread W is instantaneously drawn through the eye Ha of the heddle H by the air flow from the compression nozzle 1 to the suction nozzle 2. Furthermore, since the air is drawn by the vacuum suction pipe 24 provided in the downstream side of the air flow and therefore the suction force of the suction nozzle 2 is increased, the warp thread W can be surely drawn through the heddle eye Ha with high efficiency and high speed. After the warp thread W is passed through the heddle eye Ha, the compression air from the nozzle passagewaYs 21, 22 of the suction nozzle 2 and from the nozzle passageway 41 of the compression nozzle 1 is interrupted, and also the second nozzle block 12 of the suction nozzle 2 is moved away from the first nozzle block 11 of the suction nozzle 2 by means of the pivot arm 14 which is pivoted upward by the downward movement of the rod 18. Likewise, the second nozzle block 32 of the compression nozzle 1 is moved away from the first nozzle block 31 of the compression nozzle 1 by means of the pivot arm 34 which is pivoted upward by the downward movement of the rod 38. At the same time, the suction nozzle 2 is moved back in the opposite direction to the direction E, and the compression nozzle 1 is moved back in the opposite direction to the direction C. Finally, the heddle H with the warp thread W drawn therethrough is moved in the direction B of FIG. 2 to remove the warp thread W.

Figure 8:
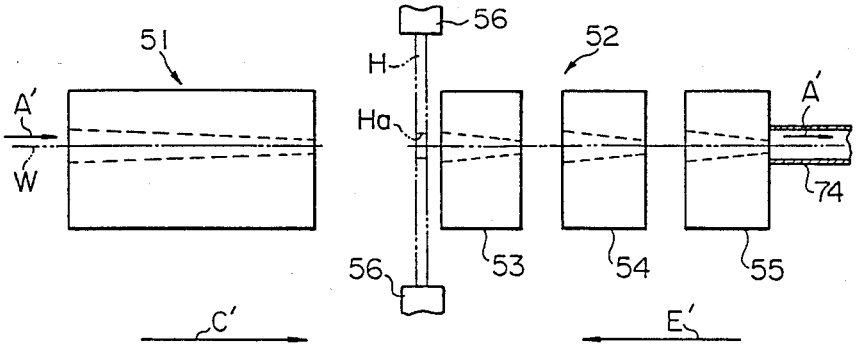
FIG. 8 is a schematic side view showing compression and suction nozzles of a warp-drawing apparatus in accordance with another embodiment of the present invention, the suction nozzle consisting of a plurality of suction nozzle units.

FIG. 8 schematically shows a second embodiment of a warp-drawing apparatus according to the present invention. The warp-drawing apparats comprises a compression nozzle generally designated by reference numeral 51 and a suction nozzle generally designated by reference numeral 52, which are arranged in an axial alignment with each other. The compression nozzle 51 is provided on one side of a heddle H with an eye Ha, while the suction nozzle 52 is provided on the other side of the heddle H so as to be movable in a direction indicated by the E' in FIG. 8 toward the compression nozzle 51 and in the opposite direction away from the compression nozzle 51. The suction nozzle 52 is divided in a direction indicated by the arrow A' in FIG. 8, in which a warp thread W is drawn through the eye Ha of the heddle H, into a first suction nozzle unit 53, a second suction nozzle unit 54 and a third suction nozzle unit 55. In drawing the warp thread W through the eye Ha of the heddle H, the first, second and third suction nozzle units 53, 54 and 55 are advanced in the direction E' toward the heddle H and engaged with one another, and after the warp thread W is drawn through the eye Ha of the heddle H, the first, second and third suction nozzle units 53, 54 and 55 are moved back in the opposite direction away from the heddle H. The second suction nozzle unit 54 is spaced from the first suction nozzle unit 53 so that a thread, which is used for separating warp threads from one another, is able to cross the warp thread W drawn through the heddle eye Ha. The third suction nozzle unit 55 is also spaced from the second suction nozzle unit 54 so that the loose end of the warp thread W drawn through the heddle eye Ha can be readily removed. A heddle-positioning means 56 is provided to hold the upper and lower ends of the heddle H and to position the heddle H between the compression and suction nozzles 51 and 52. In drawing the warp thread W through the eye Ha of the heddle H, the compression nozzle 51 is advanced in a direction indicated by the arrow C' in FIG. 8 toward the heddle H and engages with the heddle H, and after the warp thread W is drawn through the eye Ha of the heddle H, the compression 51 is moved back in the opposite direction away from the heddle H. The first, second and third suction nozzle units 53, 54 and 55 of the suction nozzle 52, and the compression nozzle 51 is moved toward and away from one another by suitable drive means.

Figure 9:
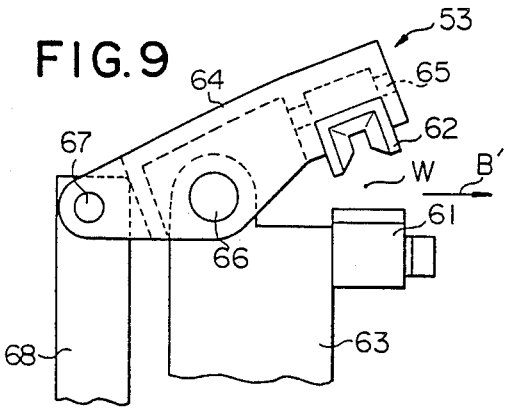
FIG. 9 is an enlarged front view, partly broken away, showing one of the suction nozzle units shown in FIG. 8, wherein the suction nozzle unit is opened to remove the warp thread that has been drawn through the heddle eye.
Figure 10:
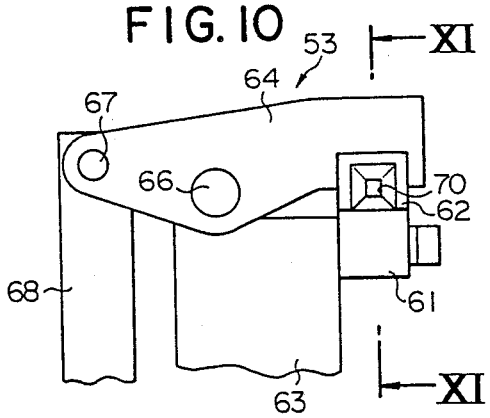
FIG. 10 is a view similar to FIG. 9 showing the suction nozzle unit that is closed to form a suction passageway through which the warp thread is drawn.
Figure 11:
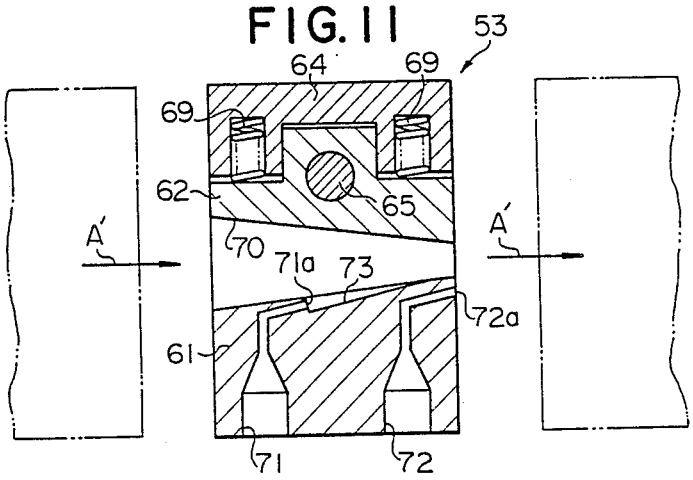
FIG. 11 is an enlarged sectional view substantially taken along line XI—XI.

Referring to FIG. 9 through FIG. 11, the first suction nozzle unit 53 of the suction nozzle 52 comprises a first stationary nozzle block 61 and a second nozzle block 62 movable toward and away from the first stationary nozzle block 61. The first nozzle block 61 is stationarily mounted on a nozzle supporting member 63, while the second nozzle block 62 is rotatably mounted on a pivot arm 64 through a pin 65 fixed to the latter. The pivot arm 64 is pivotably mounted through a support pin 66 on the nozzle supporting member 63 and also connected through a connection pin 67 to a rod 68. The pivot arm 64 is caused to pivot on the support pin 66 by the upward and downward movements of the rod 68, and accordingly the second nozzle block 62 is movable toward and away from the first nozzle block 61. As clearly shown in FIG. 11, the second nozzle block 62 is urged toward the first nozzle block 61 by means of springs 69 and 69 mounted in the pivot arm 64, and when the second nozzle block 62 is brought into engagement with the first nozzle block 61, the springs 69 and 69 serve to absorb the shocks of the both nozzle blocks 61 and 62.

When the second nozzle block 62 is held in engagement with the first nozzle block 61, they define therebetween a suction passageway 70 having a section which is gradually reduced in a direction A' of air flow, as shown in FIG. 11. The suction passageway 70 has a generally square cross section, a taper surface forming the lower side of the square being formed in the first nozzle block 61 and taper surfaces forming the other sides of the square being formed in the second nozzle block 62. As a result, when the second nozzle block 62 is moved away from the first nozzle block 61, the warp thread W can be easily removed from the suction nozzle unit 53 in a direction indicated by the arrow B' in FIG. 9. As previously indicated, in order to easily remove the warp thread W from the suction nozzle unit 53, it is necessary to make the taper surface of the first nozzle block 61 as smooth as possible. As shown in FIG. 11, the first nozzle block 61 of the suction nozzle unit 53 is formed with a first nozzle passageway 71 having an open end 71*a* which is open to a recess 73 formed in the taper surface of the block 61, and is further formed with a second nozzle passageway 72 having an open end 72*a* which is open to the end face of the nozzle block 61 adjacent the exit end of the suction passageway 70. Compression air is injected from the first nozzle passageway 71 into the suction passageway 70 to cause the latter to become in a vacuum condition. Also, compression air is injected from the second nozzle passageway 72 to accelerate the air injected from the suction passageway 70. The second and third suction nozzle units 54 and 55 of the suction nozzle 52 are substantially identical in construction and operation to the first suction nozzle unit 53 above described, and therefore the description will be omitted.

A vacuum suction pipe or means 74 is provided rearward of the third suction nozzle unit 55, i.e., downstream of the air flow. The vacuum suction pipe 74 is attached to the third suction nozzle unit 55 and movable together with the latter, and serves to increase the suction force of the suction nozzle 52 by drawing the air from the exit end of the third suction nozzle unit 55 in the direction A'. The compression nozzle 51 serves to inject compression air to the side of the suction nozzle 52.

Figure 12:
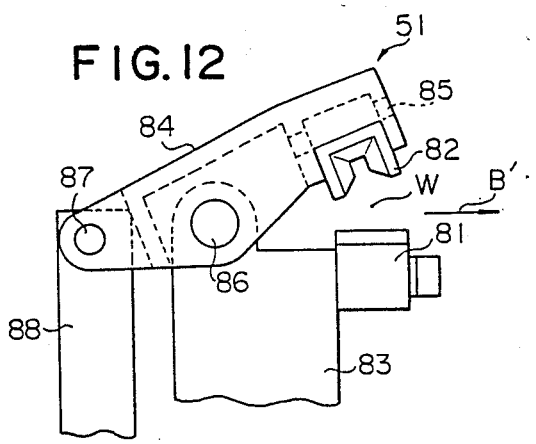
FIG. 12 is an enlarged front view, partly broken away, showing the compression nozzle of FIG. 8 that is opened.
Figure 13:
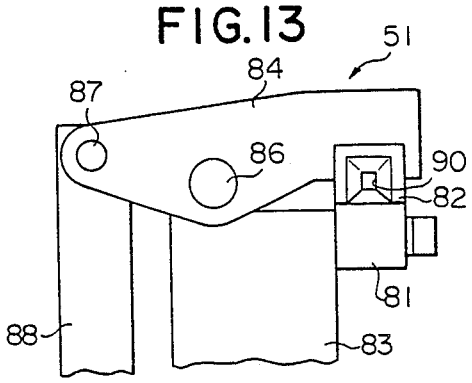
FIG. 13 is a view similar to FIG. 12 showing the compression nozzle that is closed.
Figure 14:
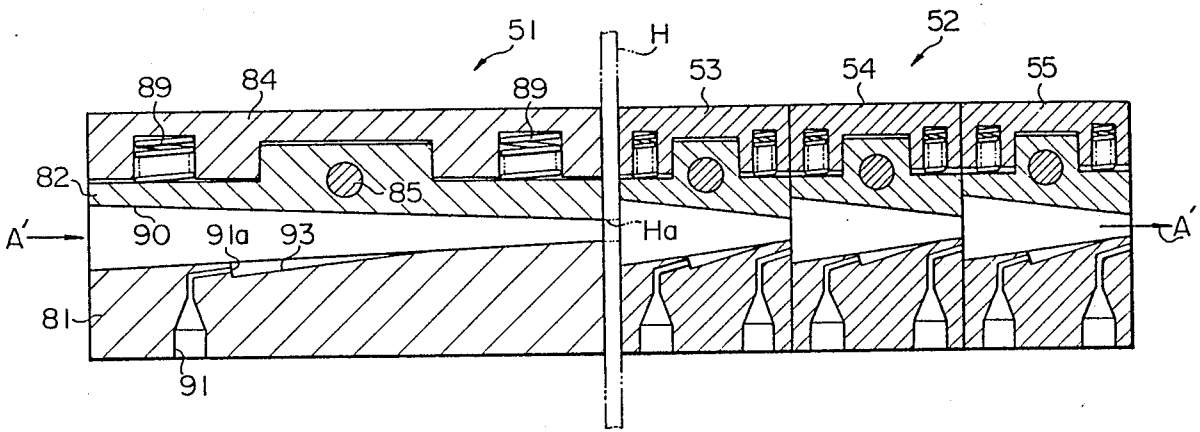
FIG. 14 is a longitudinal sectional view showing the compression nozzle and the suction nozzle units of FIG. 8 that have been advanced and engaged with the heddle.

Referring to FIGS. 12, 13 and 14, the compression nozzle 51 comprises a first stationary nozzle block 81 and a second nozzle block 82 movable toward and away from the first stationary nozzle block 81. The first nozzle block 81 is stationarily mounted on a nozzle supporting member 83, while the second nozzle block 82 is rotatably mounted on a pivot arm 84 through a pin 85 fixed to the latter. The pivot arm 84 is pivotably mounted through a support pin 86 on the nozzle supporting member 83 and also connected through a connection pin 87 to a rod 88. The pivot arm 84 is caused to pivot on the support pin 86 by the upward and downward movements of the rod 88, and accordingly the second nozzle block 82 is movable toward and away from the first nozzle block 81. As clearly shown in FIG. 14, the second nozzle block 82 is urged toward the first nozzle block 81 by means of springs 89 and 89 mounted in the pivot arm 84, and when the second nozzle block 82 is brought into engagement with the first nozzle block 81, the springs 89 and 89 serve to absorb the shocks of the both nozzle blocks 81 and 82.

When the second nozzle block 82 is held in engagement with the first nozzle block 81, they define therebetween a compression passageway 90 having a section which is gradually reduced in the direction wherein the warp thread W is drawn, i.e., in the direction A' of air flow, as shown in FIG. 14. The compression passageway 90 has a generally square cross section, a taper surface forming the lower side of the square being formed in the first nozzle block 81 and taper surfaces forming the other sides of the square being formed in the second nozzle block 82. As a result, when the second nozzle block 82 is moved away from the first nozzle block 81, the warp thread W can be easily removed from the compression nozzle 51 in a direction indicated by the arrow B' in FIG. 12. As shown in FIG. 14, the first nozzle block 81 of the compression nozzle 51 is formed with a nozzle passageway 91 having an open end 91*a* which is open to a recess 93 formed in the taper surface of the block 81. Compression air is injected from the nozzle passageway 91 into the compression passageway 90 to cause the latter to become in a vacuum condition, and is supplied to the side of the suction nozzle 52 from the exit end of the compression passageway 90 through the eye Ha of the heddle H.

The operation of the warp-drawing apparatus shown in FIG. 8 will hereinafter be described in detail.

The heddle H is first positioned properly by the heddle-positioning means 56. Thereafter, the compression nozzle 51 is advanced in the direction C' toward the heddle H, and the first, second and third suction nozzle units 53, 54 and 55 are advanced in the direction E' toward heddle H to hold the heddle H between the compression nozzle 51 and the first suction nozzle unit 53. The first and second nozzle blocks 61 and 62 of each of the suction nozzle units 53, 54 and 55 are brought into engagement with each other, and also the first and second nozzle blocks 81 and 82 of the compression nozzle 51 are brought into engagement with each other. With these conditions, compression air is injected at high speed in the direction A' of FIG. 8 from the nozzle passageway 91 of the compression nozzle 51 and from the nozzle passageways 71 and 72 of each of the suction nozzle units 53, 54 and 55, and furthermore the compression air is drawn by the vacuum suction pipe 74 attached to the third suction nozzle unit 55.

Accordingly, the warp thread W is instantaneously drawn through the eye Ha of the heddle H by the air flow from the compression nozzle 51 to the third suction nozzle unit 55 of the suction nozzle 52. Furthermore, since the air is drawn by the vacuum suction pipe 74 provided in the downstream side of the air flow and therefore the suction force of the suction nozzle 52 is increased, the warp thread W can be surely drawn through the heddle eye Ha with high efficiency. After the warp thread W is passed through the heddle eye Ha, the compression air from the nozzle passageway 91 of the compression nozzle 51 and from the nozzle passageways 71 and 72 of each of the suction nozzle units 53, 54 and 55 is interrupted, and also the second nozzle blocks 62 of the suction nozzle units 53, 54 and 55 are all moved away from the first nozzle blocks 61 of the suction nozzle units 53, 54 and 55 by means of the pivot arm 64 which is pivoted upward by the downward movement of the rod 68. Likewise, the second nozzle block 82 of the compression nozzle 51 is moved away from the first nozzle block 81 of the compression nozzle 51 by means of the pivot arm 84 which is pivoted upward by the downward movement of the rod 88. At the same time, the suction nozzle units 53, 54 and 55 are all moved in the opposite direction to the direction E' and spaced from one another, and the compression nozzle 51 is also moved in the opposite direction to the direction C'. Finally, the heddle H with the warp thread W drawn therethrough is laterally moved in the direction B' of FIG. 9 to remove the warp thread W, and a thread, which is used for separating warp threads from one another, is able to cross the warp thread W drawn through the heddle eye Ha.

Figure 15:
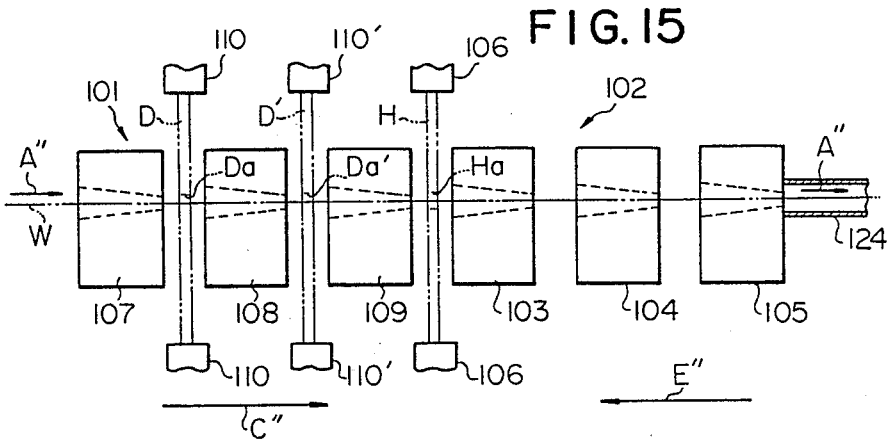
FIG. 15 is a schematic side view showing compression and suction nozzles of a warp-drawing apparatus in accordance with another embodiment of the present invention, both the compression and suction nozzles consisting of a plurality of compression nozzle units and a plurality of suction nozzle units, respectively.

FIG. 15 illustrates a third embodiment of a warp-drawing apparatus according to the present invention. The warp-drawing apparatus comprises a compression nozzle generally designated by reference numeral 101 and a suction nozzle generally designated by reference numeral 102, which are arranged in an axial alignment with each other. The compression nozzle 101 is provided on one side of a heddle H with an eye Ha, while the suction nozzle 102 is provided on the other side of the heddle H so as to be movable in a direction indicated by the arrow E" in FIG. 15 toward the compression nozzle 101 and in the opposite direction away from the compression nozzle 101. The suction nozzle 102 is divided in a direction indicated by the arrow A" in FIG. 15, in which a warp thread W is drawn through the eye Ha of the heddle H, into first suction nozzle unit 103, a second suction nozzle unit 104 and a third suction nozzle unit 105. In drawing the warp thread W through the eye Ha of the heddle H, the first, second and third suction nozzle units 103, 104 and 105 are advanced in the direction E" toward the heddle H and engaged with one another, and after the warp thread W is drawn through the eye Ha of the heddle H, the first, second and third suction nozzle units 103, 104 and 105 are moved back in the opposite direction away from the heddle H. The second suction nozzle unit 104 is spaced from the first suction nozzle unit 103 so that a thread, which is used for separating warp threads from one another, is able to cross the warp thread W drawn through the heddle eye Ha. The third suction nozzle unit 105 is spaced from the second suction nozzle unit 104 so that the loose end of the warp thread W drawn through the heddle eye Ha can be readily removed. A heddle-positioning means 106 is provided to hold the upper and lower ends of the heddle H and to position the heddle H between the compression and suction nozzles 101 and 102. The compression nozzle 101 is also divided in the direction A" into a first compression nozzle unit 107, a second compression nozzle unit 108 and a third compression nozzle unit 109. In drawing the warp thread W through the heddle eye Ha, the first, second and third compression nozzle units 107, 108 and 109 are advanced in a direction indicated by the arrow C" in FIG. 15 toward the heddle H and engaged with one another, and after the warp thread W is drawn through the heddle eye Ha, the first, second and third compression nozzle units 107, 108 and 109 are moved back in the opposite direction away from the heddle H. A first drop-positioning means 110 is provided to hold the upper and lower ends of a first drop D with an aperture Da and to position the drop D between the first compression nozzle unit 107 and the second compression nozzle unit 108. Similarly, a second drop-positioning means 110" is provided to hold the upper and lower ends of a second drop D' with an aperture Da' and to position the drop D' between the second compression nozzle unit 108 and the third compression nozzle unit 109. The first, second and third suction nozzle units 103, 104 and 105 of the suction nozzle 102, and the first, second and third compression nozzle units 107, 108 and 109 of the compression nozzle 101 are moved toward and away from one another by suitable drive means.

Figure 16:
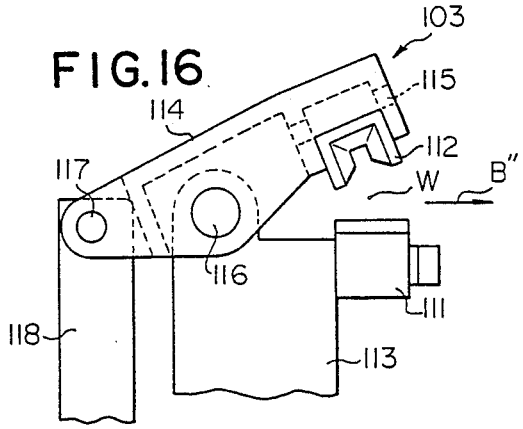
FIG. 16 is an enlarged front view, partly broken away, showing one of the suction nozzle units shown in FIG. 15, the suction nozzle unit being opened to remove the warp thread that has been drawn through the heddle eye.
Figure 17:
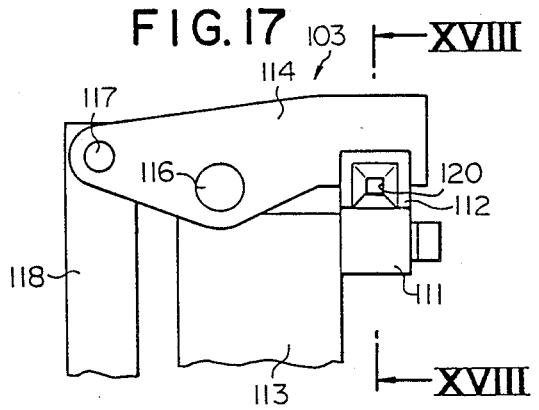
FIG. 17 is a view similar to FIG. 16 showing the suction nozzle unit of FIG. 16 that is closed to form a suction passageway through which the warp thread is drawn.
Figure 18:
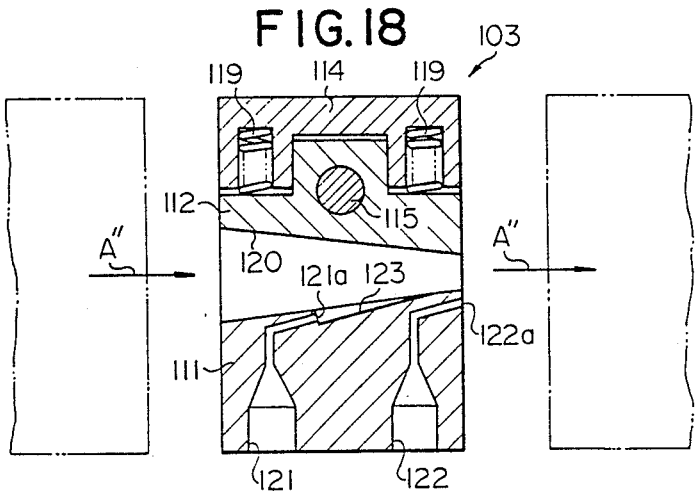
FIG. 18 is an enlarged cross sectional view substantially taken along line XVIII—XVIII in FIG. 17.

Referring to FIG. 16 through FIG. 18, the first suction nozzle unit 103 of the suction nozzle 102 comprises a first stationary nozzle block 111 and a second nozzle block 112 movable toward and away from the first stationary nozzle block 111. The first nozzle block 111 is stationarily mounted on a nozzle supporting-member 113, while the second nozzle block 112 is rotatably mounted on a pivot arm 114 through a pin 115 fixed to the latter. The pivot arm 114 is pivotably mounted through a support pin 116 on the nozzle supporting member 113 and also connected through a connection pin 117 to a rod 118. The pivot arm 114 is caused to pivot on the support pin 116 by the upward and downward movements of the rod 118, and accordingly the second nozzle block 112 is movable toward and away from the first nozzle block 111. As clearly shown in FIG. 18, the second nozzle block 112 is urged toward the first nozzle block 111 by means of springs 119 and 119 mounted in the pivot arm 114, and when the second nozzle block 112 is brought into engagement with the first nozzle block 111, the springs 119 and 119 serve to absorb the shocks of the both nozzle blocks 111 and 112.

When the second nozzle block 112 is held in engagement with the first nozzle block 111, they form therebetween a suction passageway 120 having a section which is gradually reduced in the direction A″, as shown in FIG. 18. The suction passageway 120 has a generally square cross section, a taper surface forming the lower side of the square being formed in the first nozzle block 111 and taper surfaces forming the other sides of the square being formed in the second nozzle block 112. As a result, when the second nozzle block 112 is moved away from the first nozzle block 111, the warp thread W can be easily removed from the suction nozzle unit 103 in a direction indicated by the arrow B″ in FIG. 16. It is noted that, in order to easily remove the warp thread W from the suction nozzle unit 103, it is necessary to make the taper surface of the first nozzle block 111 as smooth as possible. As shown in FIG. 18, the first nozzle block 111 of the suction nozzle unit 103 is formed with a first nozzle passageway 121 having an open end 121*a* which is open to a recess 123 formed in the taper surface of the block 111, and is further formed with a second nozzle passageway 122 having an open end 122*a* which is open to the end face of the nozzle block 111 adjacent the exit end of the suction passageway 120. Compression air is injected from the first nozzle passageway 121 into the suction passageway 120 to cause the latter to be in a vacuum condition. Also, compression air is injected from the second nozzle passageway 122 to accelerate the air injected from the suction passagewaY 120. The second and third suction nozzle units 104 and 105 of the suction nozzle 102, and the first and second compression nozzle units 107 and 108 of the compression nozzle 1 are all substantially identical in construction and operation to the first suction nozzle unit 103 above described, and therefore the description will be omitted.

A vacuum suction pipe or means 124 is provided rearward of the third suction nozzle unit 105, i.e., downstream of the air flow. The vacuum suction pipe 124 is attached to the third suction nozzle unit 105 and movable together with the latter, and serves to increase the suction force of the suction nozzle 102 by drawing the air from the exit end of the third suction nozzle unit 105 in the direction A″. The compression nozzle 101 serves to inject the compression air to the side of the suction nozzle 102, and when the first, second and third compression nozzle units 107, 108 and 109 are held in engagement to one another, the third compression nozzle unit 109 is engaged with the heddle H.

Figure 19:
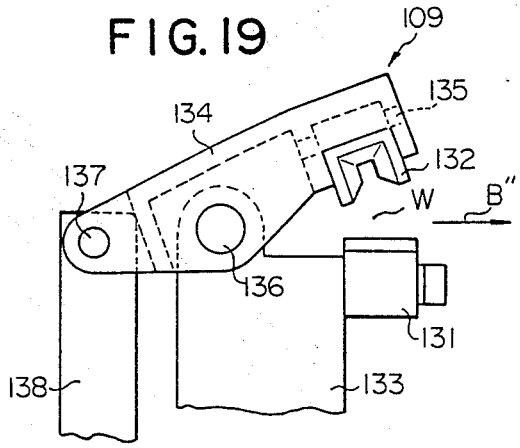
FIG. 19 is an enlarged front view, partly broken away, showing one of the compression nozzle units of FIG. 15 that is opened.
Figure 20:
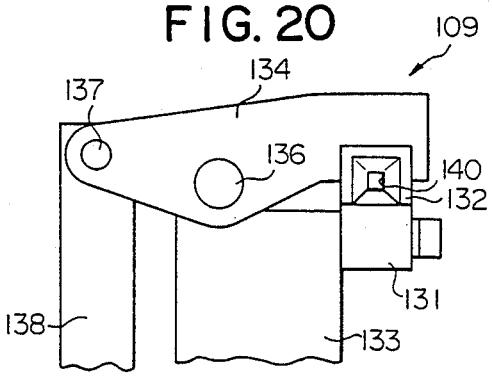
FIG. 20 is a view similar to FIG. 19 showing the compression nozzle unit of FIG. 19 that is closed.
Figure 21:
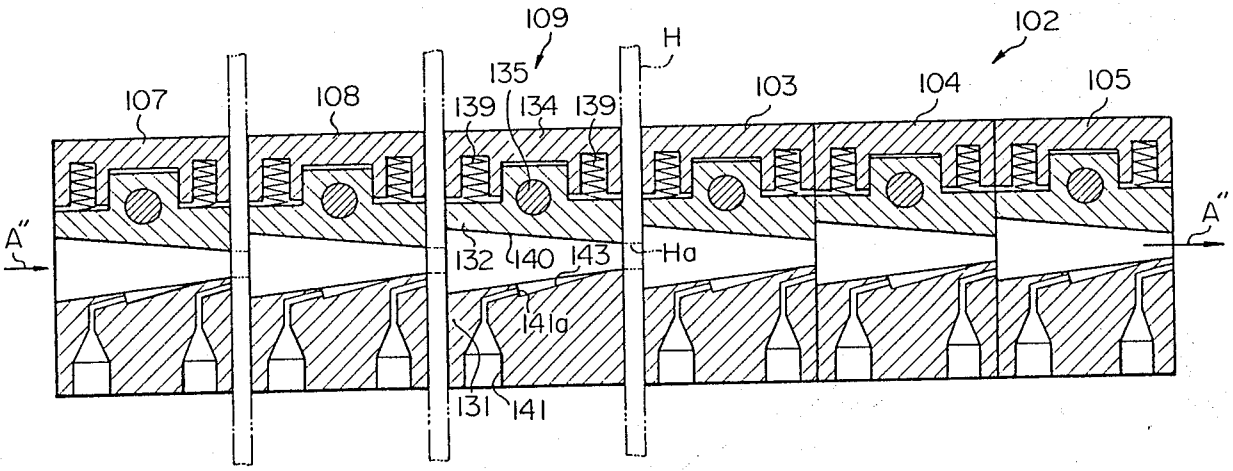
FIG. 21 is a longitudinal sectional view showing the compression and suction nozzle units of FIG. 15 that have been advanced and engaged with the heddle.

Referring to FIGS. 19, 20 and 21, the third compression nozzle unit 109 of the compression nozzle 101 comprises a first stationary nozzle block 131 and a second nozzle block 132 movable toward and away from the first stationary nozzle block 131. The first nozzle block 131 is stationarily mounted on a nozzle supporting member 133, while the second nozzle block 132 is rotatably mounted on a pivot arm 134 through a pin 135 fixed to the latter. The pivot arm 134 is pivotably mounted through a support pin 136 on the nozzle supporting member 133 and also connected through a connection pin 137 to a rod 138. The pivot arm 134 is caused to pivot on the support pin 136 by the upward and downward movements of the rod 138, and accordingly the second nozzle block 132 is movable toward and away from the first nozzle block 131. As clearly shown in FIG. 21, the second nozzle block 132 is urged toward the first nozzle block 131 by means of springs 139 and 139 mounted in the pivot arm 134, and when the second nozzle block 132 is brought into engagement with the first nozzle block 131, the springs 139 and 139 serve to absorb the shocks of the both nozzle blocks 131 and 132.

When the second nozzle block 132 is held in engagement with the first nozzle block 131, they form therebetween a compression passageway 140 having a section which is gradually reduced in the direction A″, as shown in FIG. 21. The compression passageway 140 has a generally square cross section, a taper surface forming the lower side of the square being formed in the first nozzle block 131 and taper surfaces forming the other sides of the square being formed in the second nozzle block 132. As a result, when the second nozzle block 132 is moved away from the first nozzle block 131, the warp thread W can be easily removed from the compression nozzle unit 109 in a direction indicated by the arrow B″ in FIG. 19. As shown in FIG. 21, the first nozzle block 131 is formed with a nozzle passageway 141 having an open end 141*a* which is open to a recess 143 formed in the taper surface of the block 131. Compression air is injected from the first nozzle 141 into the compression passageway 140 to cause the latter to become in a vacuum condition, and is supplied to the side of the suction nozzle 102 from the exit end of the compression passageway 140 through the eye Ha of the heddle H.

The operation of the warp-drawing apparatus shown in FIG. 15 will hereinafter be described in detail.

The heddle H is first positioned properly by the heddle-positioning means 106, and also the first and second drops D and D′ are properly positioned by the first and second drop-positioning means 110 and 110′, respectively. Thereafter, the first, second and third compression nozzle units 107, 108 and 109 are advanced in the direction C″ toward the heddle H, and the first, second and third suction nozzle units 103, 104 and 105 are advanced in the direction E″ toward heddle H to hold the heddle H between the third compression nozzle unit 109 and the first suction nozzle unit 103, to hold the first drop D between the first and second compression nozzle units 107 and 108, and to hold the second drop D' between the second and third compression nozzle units 108 and 109. The first and second nozzle blocks 111 and 112 of each of the suction nozzle units 103, 104 and 105 are brought into engagement with each other, and also the first and second nozzle blocks 131 and 132 of each of the compression nozzle units 107, 108 and 109 are brought into engagement with each other. With these conditions, compression air is injected at high speed in the direction A" of FIG. 15 from the nozzle passageways 121, 122 and 141 of all the nozzle units 103, 104, 105 and 107, 108, 109, and furthermore the compression air is drawn by the vacuum suction pipe 124 attached to the third suction nozzle unit 105.

Accordingly, the warp thread W is instantaneously drawn through the apertures Da and Da' of the drops D and D and through the eye Ha of the heddle H by the air flow from the first compression nozzle unit 107 to the third suction nozzle unit 105. Furthermore, since the air is drawn by the vacuum suction pipe 124 provided in the downstream side of the air flow and therefore the suction force of the suction nozzle 102 is increased, the warp thread W can be surely drawn through the apertures Da, Da' and through the eye Ha with high efficiency and high speed. After the warp thread W is passed through the apertures Da, Da' and through the eye Ha, the compression air from the nozzle passageways 121, 122 and 141 of all the nozzle units 103, 104, 105 and 107, 108, 109 is interrupted, and also the second nozzle blocks 112 of the suction nozzle units 103, 104 and 105 are moved away from the first nozzle blocks 111 of the suction nozzle units 103, 104 and 105, respectively, by means of the pivot arm 114 which is pivoted upward by the downward movement of the rod 118. Likewise, the second nozzle blocks 132 of the compression nozzle units 107, 108 and 109 are moved away from the first nozzle blocks 131 of the compression nozzle units 107, 108 and 109, respectively, by means of the pivot arm 134 which is pivoted upward by the downward movement of the rod 138. At the same time, the suction nozzle units 103, 104 and 105 are all moved in the opposite direction to the direction E" and spaced from one another, and the compression nozzle units 107, 108 and 109 are all moved in the opposite direction to the direction C" and spaced from one another. Finally, the heddle H and drops D and D' with the warp thread W drawn therethrough are laterally moved in the direction B" of FIG. 16 to remove the warp thread W, and a thread, by which the warp threads are separated from one another, is passed at right angles through the space between first and second suction nozzle units 103 and 104. While, in FIG. 21, each of the suction nozzle units 103, 104 and 105 is formed with two nozzle passageways, it is noted that it may be formed with a single nozzle passageway (the leftside nozzle passageway in FIG. 21).

From the foregoing description, it will be seen that, in accordance with the present invention, there is provided a warp-drawing apparatus in which the warp thread is surely drawn through the heddle eye with high operational efficiency by the use of air flow of high speed without having recourse to the use of the hook member.

While certain representative embodiments and details have been shown for the purpose of illustrating the present invention, it will be apparent to those skilled in this art that various changes and modifications may be made therein without departing from the spirit or scope of the invention.

What we claim is:

1. A warp-drawing apparatus for drawing a warp thread through an aperture of a drop or an eye of a heddle, comprising means for supplying said warp thread, means for positioning said drop or heddle at a predetermined position, a compression nozzle which is provided in one side of said drop or heddle and formed with a compression passageway through which said warp thread is drawn and formed with a nozzle passageway through which compression air is injected, the compression nozzle having a first nozzle block and a second nozzle block movable toward and away from said first nozzle block, the blocks defining said compression passageway, means for supplying said compression air to said nozzle passageway of said compression nozzle, means to open and close said nozzle blocks of said compression nozzle, a suction nozzle which is provided in the other side of said drop or heddle and formed with a suction passageway through which said warp thread is drawn and formed with a nozzle passageway through which compression air is injected, the suction nozzle having a first nozzle block and a second nozzle block movable toward and away from said first nozzle block, the blocks defining said suction passageway, means for supplying said compression air to said nozzle passageway of said suction nozzle, means to open and close said nozzle blocks of said suction nozzle, means for moving said compression and suction nozzles relative to said drop or heddle, suction means for drawing air from an exit of said suction passageway of said suction nozzle in a yarn drawing direction in which said warp thread is drawn through the aperture of said drop or the eye of said heddle, and means for removing said warp thread from said compression and suction nozzles after said warp thread has been drawn through the aperture of said drop or the eye of said heddle.

2. A warp-drawing apparatus as set forth in claim 1, in which said compression nozzle and suction nozzle are arranged in an axial alignment with each other.

3. A wrap-drawing apparatus as set forth in claim 2, in which said suction means is movable together with said suction nozzle.

4. A warp-drawing apparatus as set forth in claim 1, in which said compression passageway of said compression nozzle has a cross section which is gradually reduced in said yarn drawing direction.

5. A warp-drawing apparatus as set forth in claim 1, in which said suction passageway of said suction nozzle has a cross section which is gradually reduced in said yarn drawing direction.

6. A warp-drawing apparatus as set forth in claim 1, in which said nozzle passageway of said compression nozzle is formed in said first nozzle block of said compression nozzle.

7. A warp-drawing apparatus as set forth in claim 1, in which said compression passageway has a generally square cross section which is gradually reduced in said yarn drawing direction, a taper surface forming the lower side of the square being formed in said first nozzle block and taper surfaces forming the other sides of the square being formed in said second nozzle block.

8. A warp-drawing apparatus as set forth in claim 1, in which said nozzle passageway of said suction nozzle is formed in said first nozzle block of said suction nozzle.

9. A warp-drawing apparatus as set forth in claim 1, in which said suction passageway has a generally square cross section which is gradually reduced in said yarn drawing direction, a taper surface forming the lower side of the square being formed in said first nozzle block and taper surfaces forming the other sides of the square being formed in said second nozzle block.

10. A warp-drawing apparatus as set forth in claim 1, in which said suction nozzle comprises a plurality of suction nozzle units.

11. A warp-drawing apparatus as set forth in claim 10, in which each of said suction nozzle units is movable toward and away from said heddle.

12. A warp-drawing apparatus as set forth in claim 1, in which said compression nozzle comprises a plurality of compression nozzle units.

* * * * *